US008161898B2

(12) United States Patent
Fitch

(10) Patent No.: US 8,161,898 B2
(45) Date of Patent: Apr. 24, 2012

(54) SAIL HANDLING MECHANISM THAT SECURES A HEADBOARD TO A HEADCAR

(76) Inventor: Jonathan Fitch, Napa, CA (US)

( * ) Notice: Subject to any disclaimer, the term of this patent is extended or adjusted under 35 U.S.C. 154(b) by 238 days.

(21) Appl. No.: 12/730,092

(22) Filed: Mar. 23, 2010

(65) Prior Publication Data

US 2011/0232556 A1 Sep. 29, 2011

(51) Int. Cl.
*B63H 9/04* (2006.01)

(52) U.S. Cl. ..... 114/102.15

(58) Field of Classification Search ..... 114/102.1, 114/102.12, 102.15, 102.16, 102.18, 104, 114/108, 109, 111, 112, 113, 114, 115, 102.2, 114/102.21, 102.24, 102.27, 102.29, 102.3, 114/102.33

See application file for complete search history.

(56) References Cited

U.S. PATENT DOCUMENTS 8,001,916 B2 * 8/2011 Cook et al. ..... 114/102.15
8,091,496 B2 * 1/2012 Cook et al. ..... 114/108
8,091,497 B2 * 1/2012 Cook et al. ..... 114/112

* cited by examiner

*Primary Examiner* — Daniel Venne
(74) *Attorney, Agent, or Firm* — Carr & Ferrell LLP

(57) ABSTRACT

A mechanism to raise and lower the sail of a boat includes a headcar movably secured to a mast of the boat and a headboard affixed to the sail. A pulling force applied to a halyard raises the sail and causes the headboard to engage the headcar. When the sail is lowered, the headboard disengages from the headcar so that the sail furls flat on the boom.

29 Claims, 12 Drawing Sheets

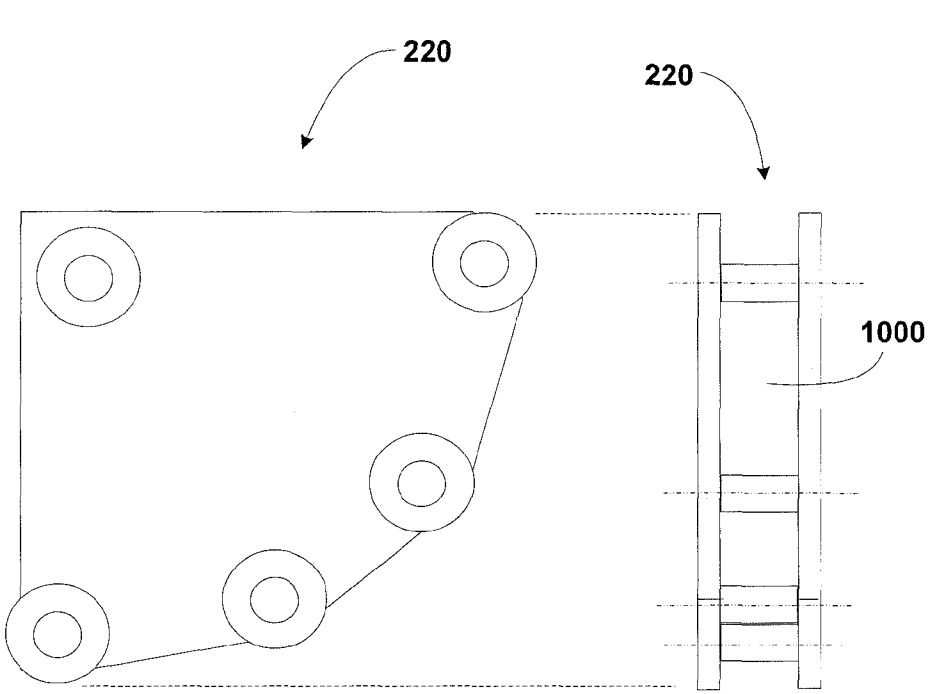
FIG. 10C
FIG. 10B
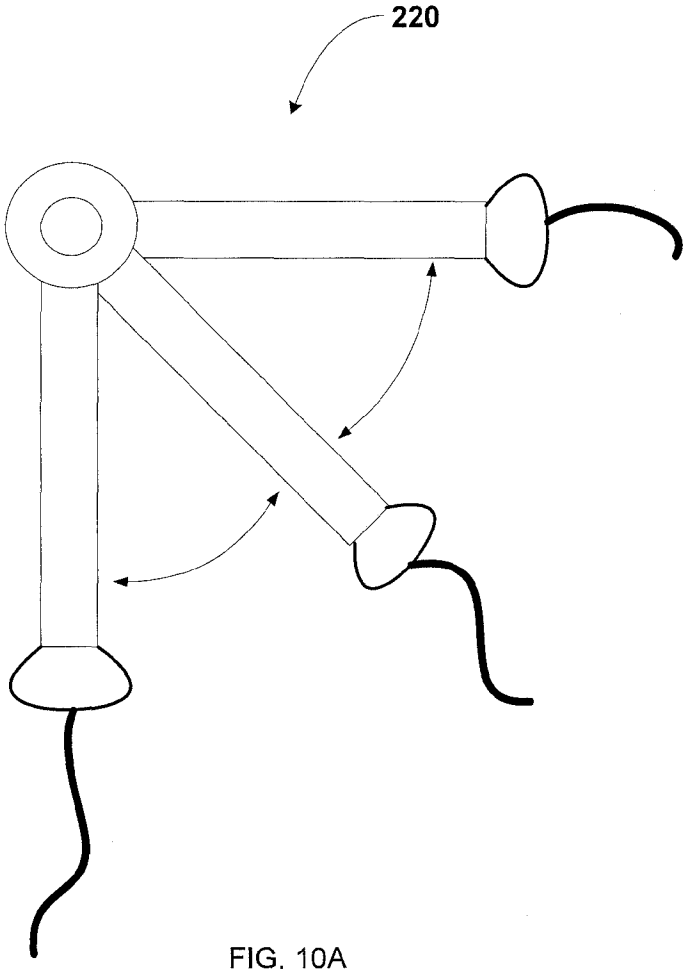
FIG. 10A

SAIL HANDLING MECHANISM THAT SECURES A HEADBOARD TO A HEADCAR

BACKGROUND OF THE INVENTION

1. Field of the Invention

The present invention generally relates to sailing equipment. The invention more specifically relates to a sail handling mechanism and method for raising and lowering the sail.

2. Background

Sails used on sailboats have historically been generally triangular in shape. The forward upper corner is called the head, the forward lower corner is called the tack, and the rear corner is called the clew. The forward edge of the sail between the head and the tack is called the luff, the lower edge of the sail between the tack and the clew is called the foot, and the aft edge between the head and the clew—the diagonal edge—is called the leach.

FIG. 1 shows a prior art sail 100. In a typical configuration, the foot of the sail is attached, at least semi-permanently, to the boom 110. The luff of the sail is attached to the mast 120 by a variety of means, the choice of attachment mechanism being determined generally by the sizes of the boat and of the sail. For relatively large sails, multiple sail slides 130 may be attached to the luff at discrete intervals. The sail slides 130 are received in a compatible track which is attached to the mast. The sail slides travel up and down the mast when the sail is raised and lowered (unfurled and furled).

Much of the load in the unfurled sail is concentrated at the head. It is therefore common practice to heavily reinforce the head corner, and to attach to the head a rigid plastic or metal board or a steel ring called a headboard 140. The headboard may then be attached to the track with one or more sail slides 130. More typically, the headboard is attached to the track with a special type of slide called a headcar or a headboard carriage.

To unfurl a sail, the sail is hauled aloft by raising the headcar and the sail slides along the track. The headcar is raised with a line, called a halyard 150, which is fastened to the headboard 140 and passes through a mast truck 160 at the top of the mast 120. One of the advantages of using multiple sail slides 130 to furl and unfurl a sail is that when the sail is dropped (furled), the slides 130 collapse against each other into a stack. The sail is folded (flaked) between the slides 130 and rests on top of the boom 110.

The most aerodynamically efficient shape for a sail is an ellipse, which is approximated by the trapezoidal shape utilized in most current art sails. Sails with this configuration may be referred to generically as squarehead sails. To maximize the efficiency of the sail, the sailmaker cuts the leach in a curve, called the roach, to provide an expanded sail area aft of the geometric triangle defined by the three corners of the sail. The modified shape allows additional power to be generated from the sail.

To support the large sail area aft of the geometric triangle and to eliminate fluttering in the otherwise unsupported leach, a common practice is to distribute stiffening elements, called battens 170, along the leach. The battens 170 are made of wood, fiberglass, or other suitable materials, and are oriented roughly parallel to the boom 110 so that when the sail 100 is furled, the battens 170 lie in a tight bundle on top of one another along the boom 110.

The battens 170 may extend from luff to leach, with an aft leach end of each batten 170 secured in a pocket on the leach, and a forward luff end connected to a special sail slide 130 called a batten car. The batten cars are designed to resist the compression forces in the batten 170 caused by the tension in the curved leach of the unfurled sail, and to reduce friction in the sail furling/unfurling mechanism. The use of the specially designed batten cars has led to increased height of the stack of slides, commonly called the stack height, when the sail is furled.

The increased stack height becomes an issue only because in order to support the upper aft corner of a squarehead sail, the uppermost batten 170 may be set at a steep angle relative to the foot of the sail 100. The angle helps the batten 170 to resist the compression forces caused by the tension in the sail fabric. A triangle of sail cloth—bounded by the headcar, the uppermost batten car, and the leach end of the uppermost batten 170—supports the uppermost batten 170 when the sail 100 is being dropped, so that the uppermost batten 170 may not properly fold down onto the boom 110. Therefore in order to properly furl the sail 100, the uppermost batten 170 must be detached from its diagonal position, either by removing the aft end of the batten 170 from the leach pocket, or by detaching the headboard 140 from the headcar.

The requirement of detaching the uppermost batten 170 can be problematic because with even fairly common boat and sail dimensions, it is not uncommon for the combined boom height, sail slide stack height, and length of the uppermost batten 170 to leave the leach end of the uppermost batten 170 and the headboard at a height—which may be twelve feet or more—above the deck that is unreachable by anyone standing on the deck.

On racing boats it is common to have a large crew who are used to climbing the mast for various reasons. It is therefore no great problem to send a crewman up the mast far enough to either remove the diagonal batten from the leach pocket, or to detach the headboard from the headcar to allow the sail to be properly furled, and to reverse the procedure when the sail is hoisted. However, on a cruising boat without a large crew, it is both inconvenient and potentially dangerous to have to climb the mast to set or furl the sail. To date, this problem has limited the application of the more efficiently constructed sails, as described above, on cruising boats.

Therefore, for the safety and convenience reasons discussed above, there is a need for a mechanism that allows an operator of a boat with relatively large sails to attach and detach a headboard 140 from a headcar without leaving the deck of the boat.

SUMMARY OF THE INVENTION

Various embodiments of the present invention provide a mechanism to automatically secure a headboard to a headcar during the hoisting of a sail, and to automatically detach the headboard from the headcar when the sail is lowered. The system employing the mechanism allows the operator of the boat to remain on the deck for the entire furling and unfurling operations. The necessity of climbing the mast to manually detach and re-attach the uppermost batten is eliminated.

The mechanism includes a headcar movably secured to a mast and a headboard affixed to a sail. The headcar pivots about an axis parallel to the longitudinal axis of the mast to track the motion of the sail.

A halyard in communication with both the headcar and the headboard supplies the motive force to raise and lower the sail. When the sail is lowered, the headboard is separated from the headcar, thereby allowing an uppermost batten to lay flat against the boom so that the sail can be easily secured.

To raise the sail, a pulling force is applied to the halyard, moving the headcar up a track in the mast. As the sail is raised, the headboard engages the headcar. A securing element holds the headboard in position adjacent the headcar.

The headboard may include a receiving cavity that receives at least a portion of the headcar when the headboard is engaged with the headcar. The headcar may include a nosepiece to facilitate the engagement of the headcar with the headboard.

The headcar may also include a pivoting toggle. The toggle may pivot upward and contact a portion of the headboard to hold the headboard in position engaged with the headcar.

BRIEF DESCRIPTION OF THE DRAWINGS

FIG. 10A illustrates a headboard with multiple sail attachment points and with hinged members.

FIG. 10B illustrates a fixed, rigid headboard with multiple sail attachment points.

FIG. 10C is a side view of the headboard shown in FIG. 10B.

DETAILED DESCRIPTION

The present invention provides a system for raising and lowering a sail on a sailboat. As a user lowers an unfurled sail, the headboard disengages from a corresponding headcar. With the headboard disengaged, the uppermost batten and the head of the luff of the sail are free to move away from the mast as the sail is furled. The uppermost batten folds down to a position generally parallel to the other battens, and the sail assumes a properly folded position resting on the boom. To unfurl the sail, the user applies a pulling force with a halyard. As the pulling force raises the sail, the headboard engages the headcar so that the sail is raised to a fully deployed position.

Figure 1B:
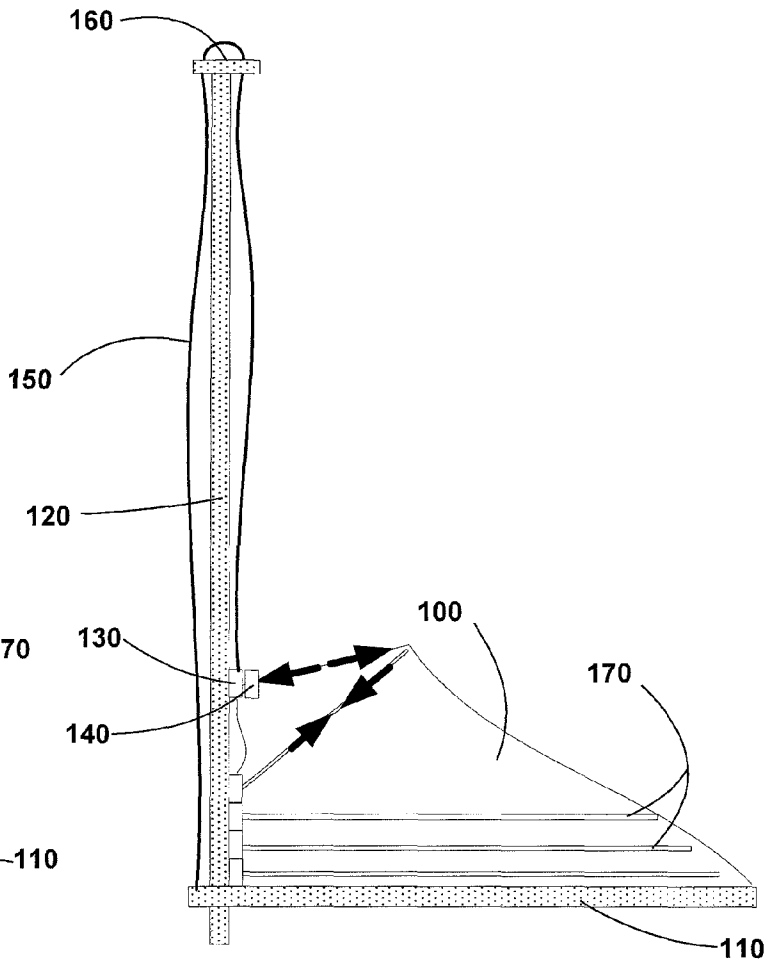
FIG. 1B PRIOR ART
FIG. 1B is an illustration of a furled prior art squarehead sail.
Figure 1A:
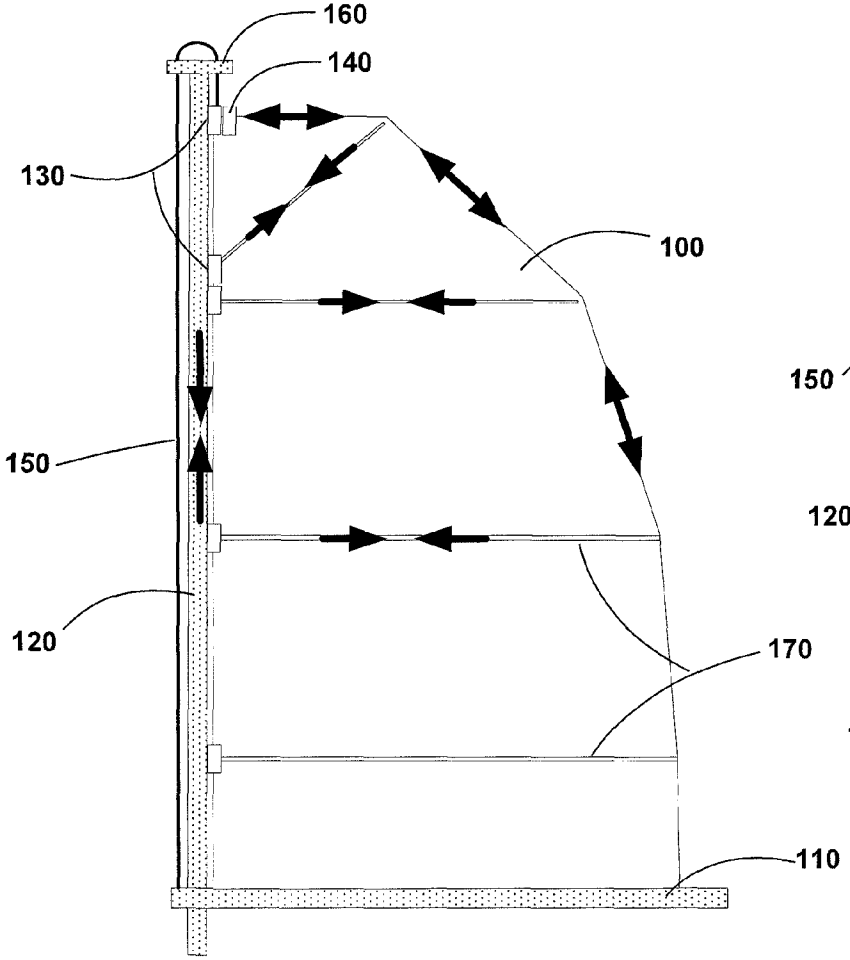
FIG. 1A PRIOR ART
FIG. 1A is an illustration of an unfurled prior art squarehead sail.
Figure 2C:
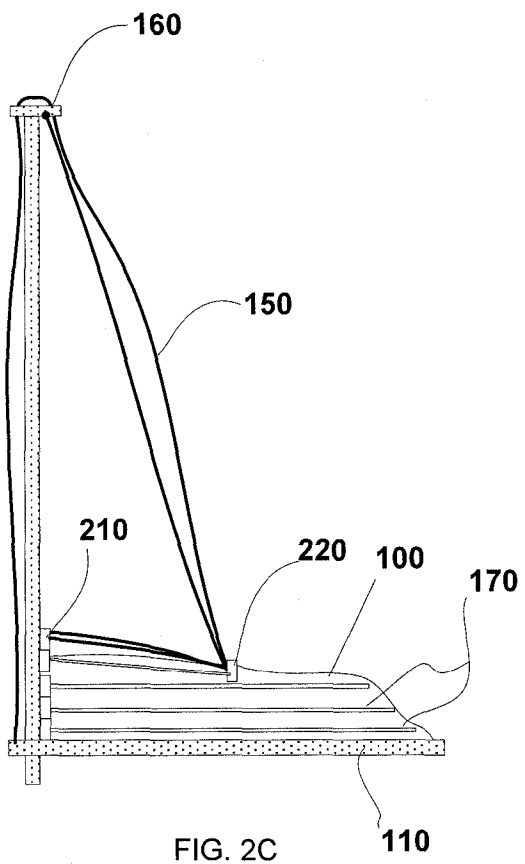
FIG. 2C shows a squarehead sail lowered to a furled position with the sail handling mechanism disclosed herein.
Figure 2B:
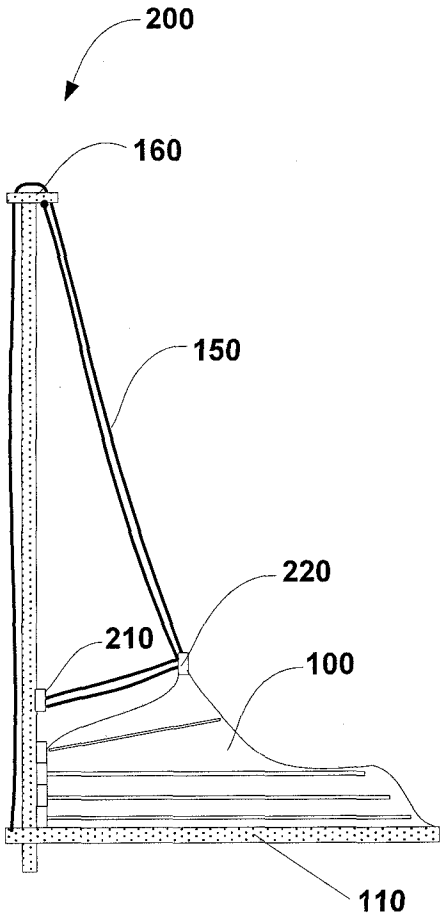
FIG. 2B shows a squarehead sail as it is being furled with the sail handling mechanism disclosed herein.
Figure 2A:
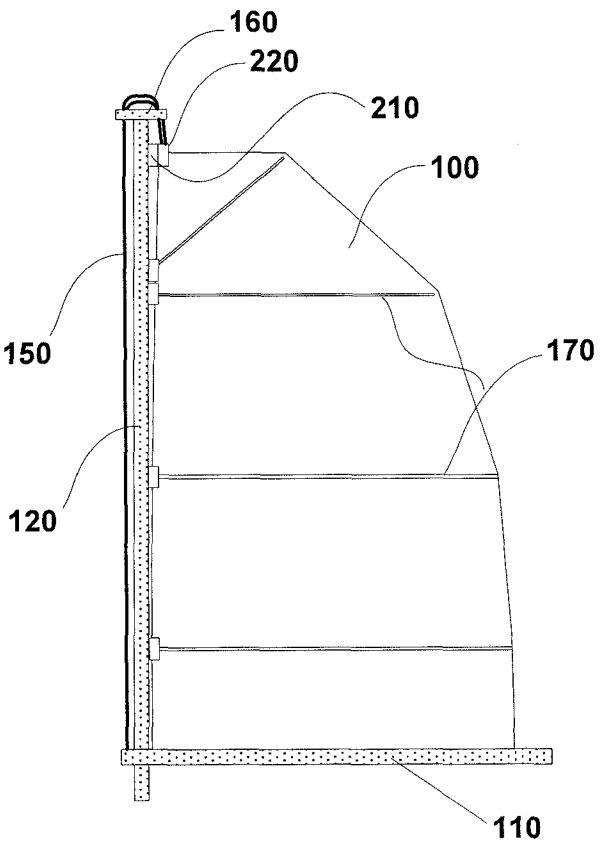
FIG. 2A shows a squarehead sail raised to an unfurled position with the sail handling mechanism disclosed herein.

FIGS. 2A-C illustrate the general operation of the system 200 of raising and lowering a sail 100. FIG. 2A shows the sail 100 in the unfurled (raised) position. When the sail 100 is in the completely unfurled position shown in FIG. 2A, a headcar 210 is at its uppermost position on the mast 120. A headboard 220 is secured in close proximity to the headcar 210. Since the sail 100 is securely fastened to the headboard 220, the sail 100 is secured in a fully unfurled position.

FIG. 2B illustrates the system 200 when the sail 100 is in an intermediate position between the fully unfurled position shown in FIG. 2A and the fully furled position shown in FIG. 2C. In the intermediate position, the headcar 210 is separated from the headboard 220 as the sail 100 is lowered. When the sail 100 is in the fully lowered position shown in FIG. 2C, the battens 170 are stacked together on top of each other on top of the boom 110.

Using the present system 200, an operator of the sailboat is able to furl and unfurl the sail 100 without leaving the deck of the sailboat. This eliminates the bothersome and sometimes dangerous necessity of climbing the mast during the raising and lowering of the sail 100.

In the configuration of the system 200 illustrated in FIGS. 2A-C, a first end of the halyard 150 is affixed to the mast truck 160. The halyard 150 passes through the headboard 220 and the headcar 210. The halyard 150 is then looped back through the headboard 220 and the mast truck 160. A free second end of the halyard 150 may then be secured in a position where the halyard 150 can be readily accessed by a user of the system 200.

As the sail 100 is lowered from the unfurled position shown in FIG. 2A, the free end of the halyard 150 is released, so that the sail 100 begins to drop. The headcar 210 begins to move downward in a slide track 1100 (See FIG. 11) on the mast 120. As the headcar 210 is lowered, the weight of the uppermost portion of the sail 100 pulls the headboard 220 away from the headcar 210 as illustrated in FIG. 2B.

As the sail 100 drops, the uppermost one of the battens 170 moves from a steeply angled position shown in FIG. 2A to a position approaching the orientation of the other battens 170 during the drop. When the sail is completely furled, as shown in FIG. 2C, all the battens 170 are stacked on the boom 110 so that the sail 100 may be easily secured.

To reverse the operation and raise the sail 100, the user applies a pulling force to the free end of the halyard 150. The tension in the halyard 150 begins to raise the headboard 220 and the sail 100 from the furled position shown in FIG. 2C. As the headboard 220 and the sail 100 are raised, the headcar 210 also begins to move upward in the slide track 1100 (see FIG. 11) on the mast 120 as shown in FIG. 2B.

As the sail 100 is raised to the unfurled position shown in FIG. 2A, the headboard 220 mates with the headcar 210 so that the topmost portion of the sail 100 is secured near the top of the mast 120 when the sail is completely unfurled. The present invention encompasses many configurations of the headcar 210 and the headboard 220 that enable the two components to mate as the sail 100 is raised. Various configurations that may be utilized for the headcar 210 and the headboard 220 are discussed in further detail below.

Figure 3C:
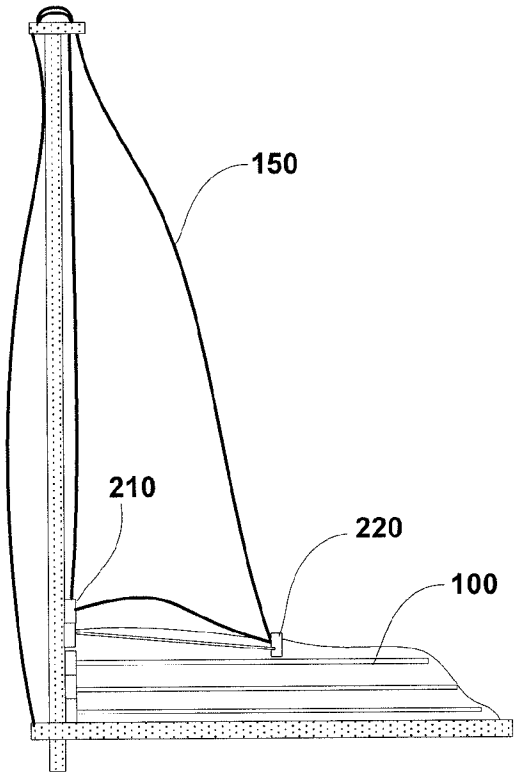
FIG. 3C shows a squarehead sail lowered to the furled position with the alternate configuration of the halyard.
Figure 3B:
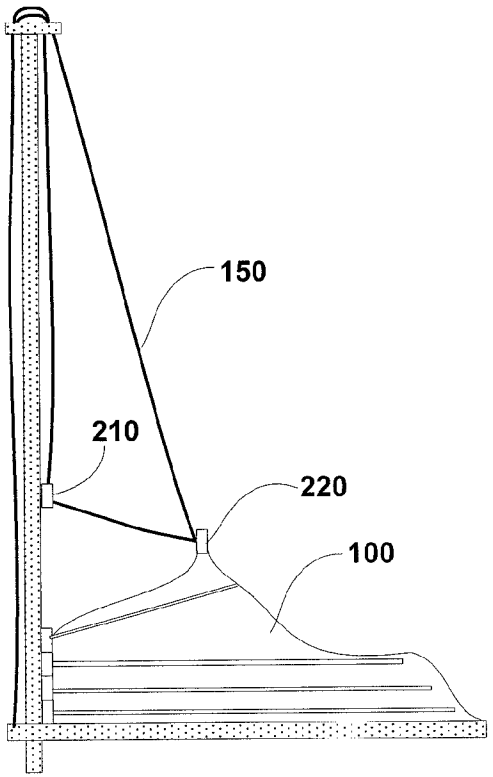
FIG. 3B shows a squarehead sail as it is being furled with the alternate configuration for the halyard.
Figure 3A:
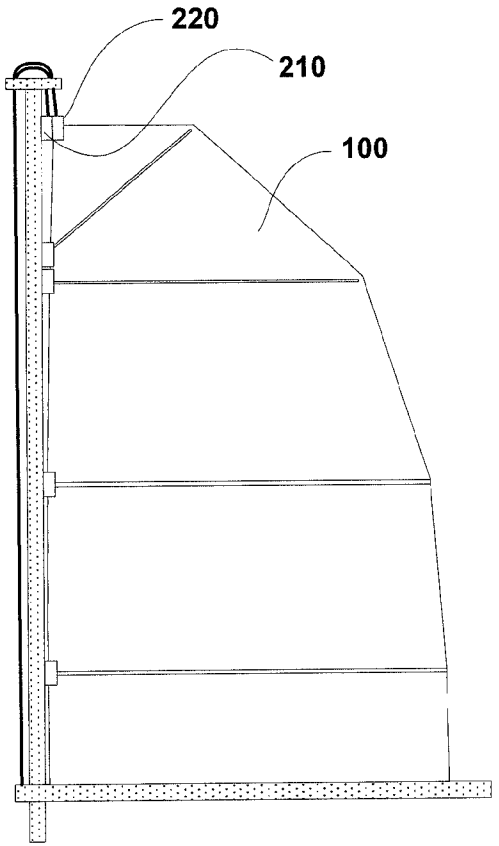
FIG. 3A shows a squarehead sail raised to the unfurled position with the sail handling mechanism utilizing an alternate configuration for the halyard.

FIGS. 3A-C show an alternate configuration for the halyard 150 in the system 200. In this configuration, the first end of the halyard 150 is affixed to the mast truck 160 as above. The halyard 150 is then routed to the headcar 210, then to the headboard 220, and then back through the mast truck 160. Operation of the system 200 remains as described above.

Figure 4C:
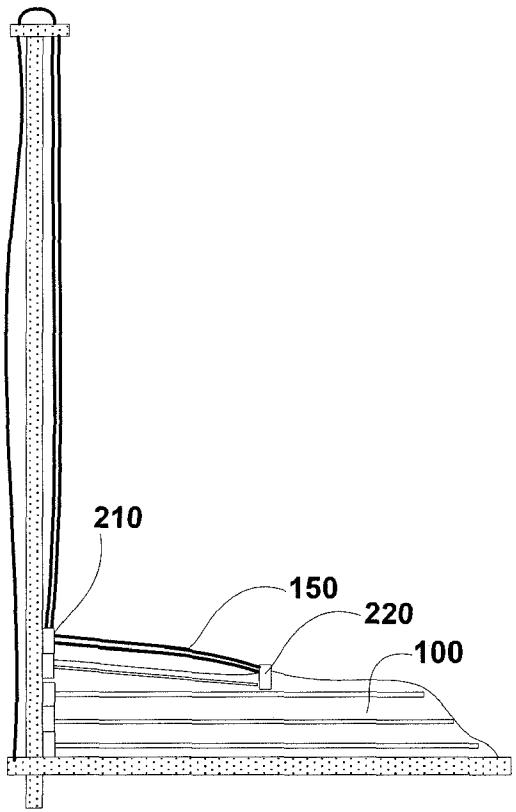
FIG. 4C shows a squarehead sail lowered to the furled position with the second alternate configuration of the halyard.
Figure 4B:
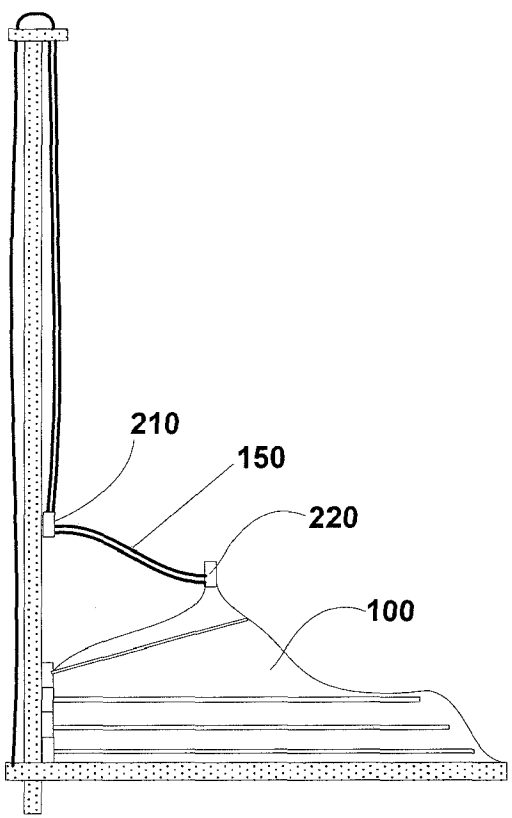
FIG. 4B shows a squarehead sail as it is being furled with the second alternate configuration of the halyard.
Figure 4A:
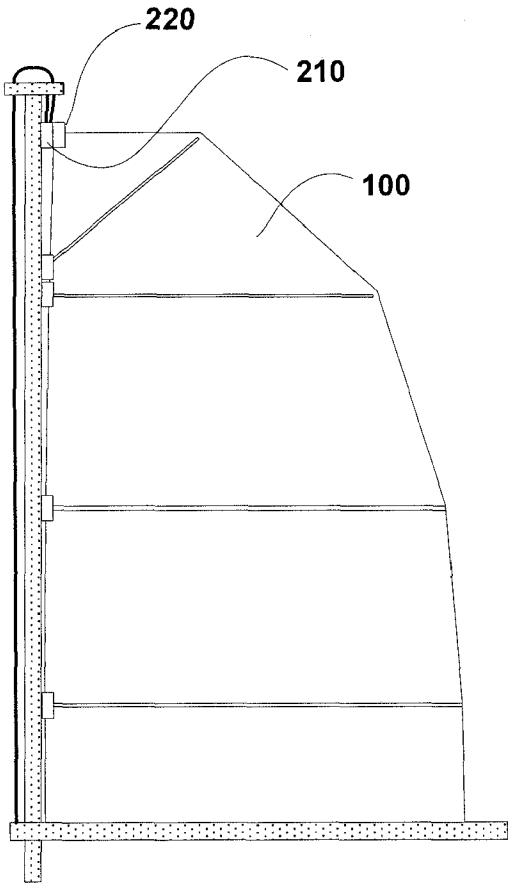
FIG. 4A shows a squarehead sail raised to the unfurled position with the sail handling mechanism utilizing a second alternate configuration of the halyard.

FIGS. 4A-C show another alternate configuration for the halyard 150 in the system 200. In the configuration of FIGS. 4A-C, the first end of the halyard 150 is affixed to the mast truck 160 as above. The halyard 150 is then routed to the headcar 210, then to the headboard 220, then back through the headcar 210, and then through the mast truck 160. Operation of the system 200 remains as described above.

Figure 5B:
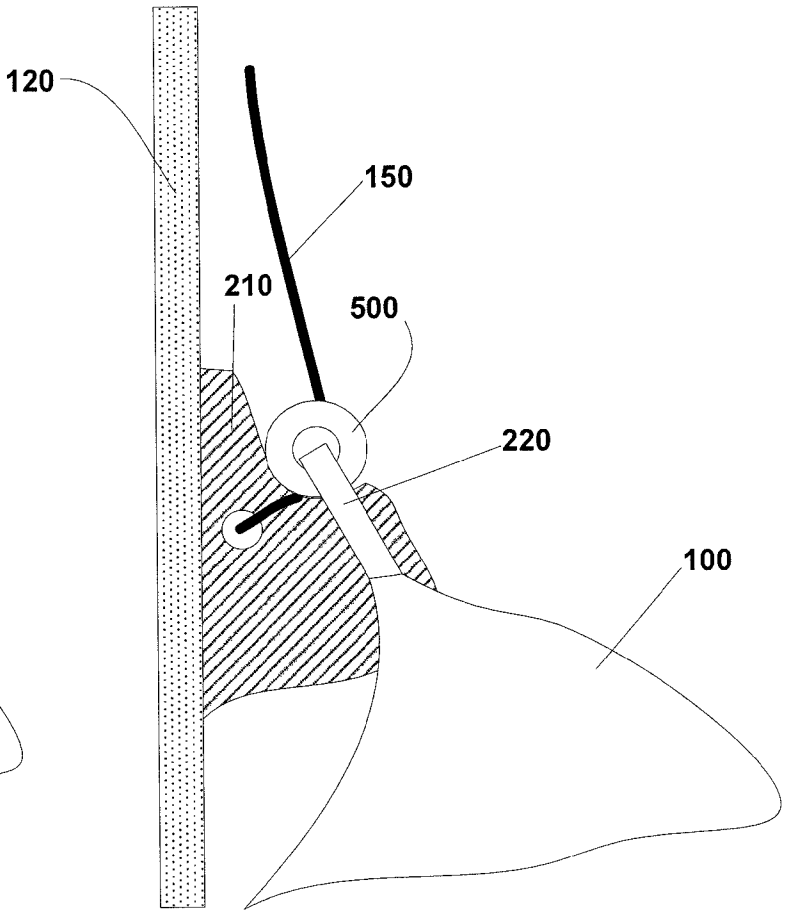
FIG. 5B illustrates the headboard of FIG. 5A mated with the headcar.
Figure 5A:
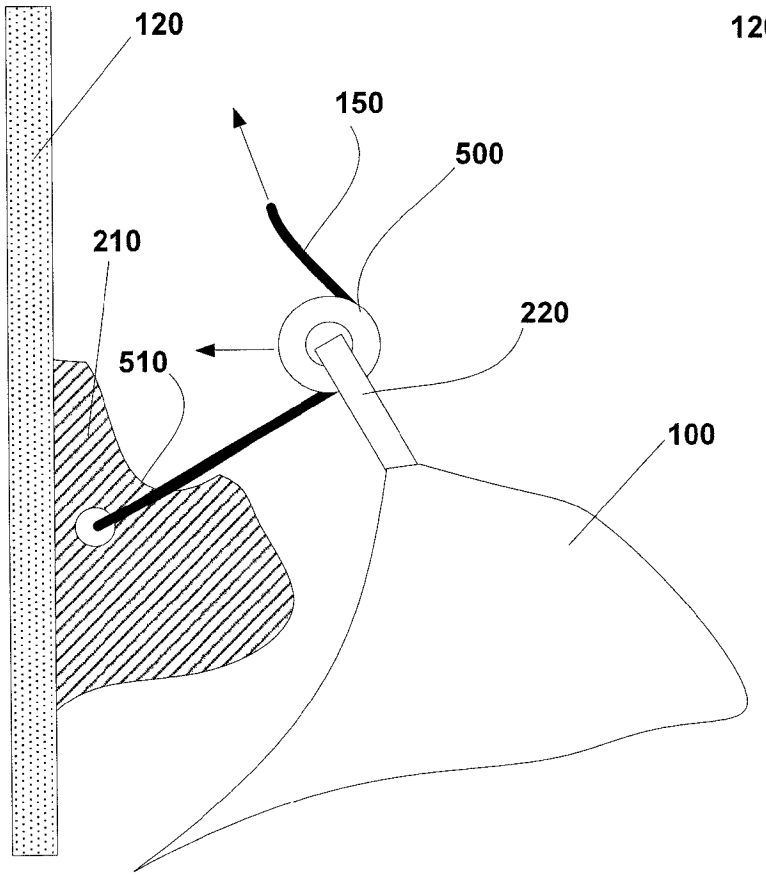
FIG. 5A illustrates a single halyard attached to a headcar and urging a headboard toward the headcar.

FIGS. 5A-B show one working configuration of the headcar 210 and the headboard 220. FIG. 5A illustrates the components as the sail 100 is being raised. The halyard 150 is looped around a sheave 500 of the headboard 220. As a pulling force is applied to the halyard 150, the halyard 150 lifts the headboard 220 upward toward the headcar 210 while the headcar 210 moves upward along the slide track 1100 (See FIG. 11) on the mast 120.

As the pulling force continues to be applied to the halyard 150, the headboard 220 mates with the headcar 210. The sheave 500 is received in a receiving area 510 of the headcar 210. The headboard 220 may be secured in position in the headcar 210 by tension in the halyard 150.

Figure 6B:
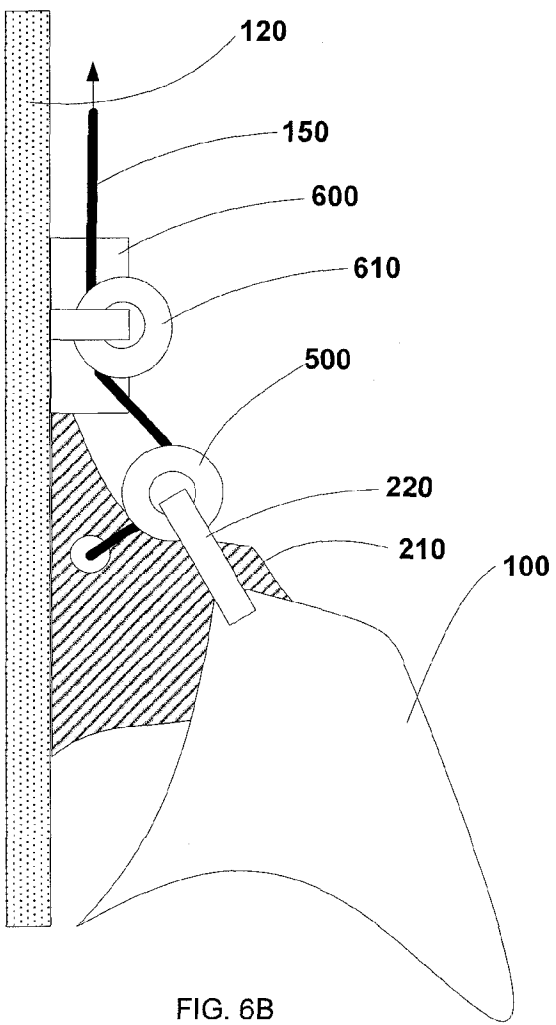
FIG. 6B illustrates the headboard of FIG. 6A mated with the first headcar.
Figure 6A:
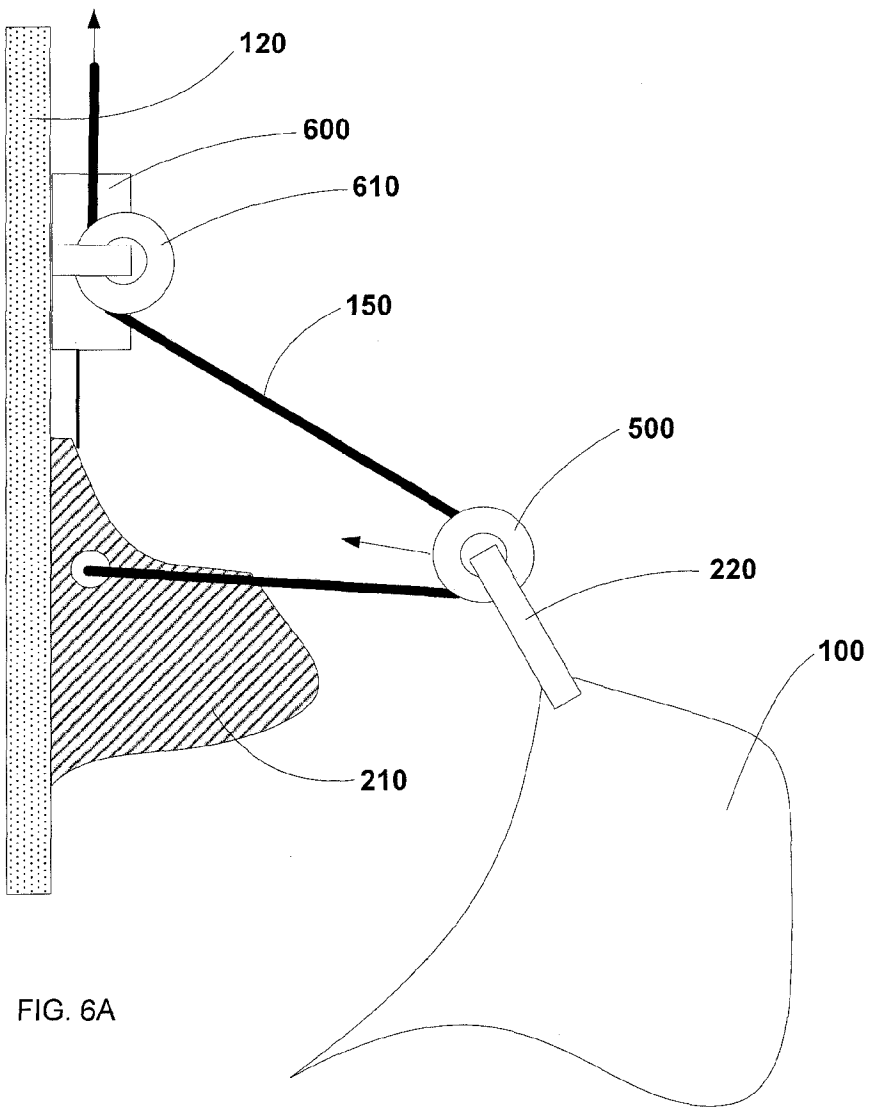
FIG. 6A illustrates a single halyard attached to a first headcar and urging a headboard toward the first headcar, the halyard then passing through a sheave on a second headcar.

In the configuration illustrated in FIGS. 6A-B, an upper portion 600 of the headcar 210 may be employed. In this configuration, the halyard 150 is routed from the headcar 210 through the sheave 500 of the headboard 220 and then through a sheave 610 of the upper portion 600 of the headcar 210.

The secondary headcar 210 may move independently from the headcar 210 in the slide track 1100 (See FIG. 11) on the mast 120. Alternatively, the upper portion 600 may be movably or fixedly coupled to the headcar 210. In configurations that include an upper portion 600 that is independent from or movably coupled with the headcar 210, when the sail 100 reaches the unfurled position, the upper portion 600 is pulled into a position adjacent to the headcar 210 as illustrated in FIG. 6B.

Figure 7B:
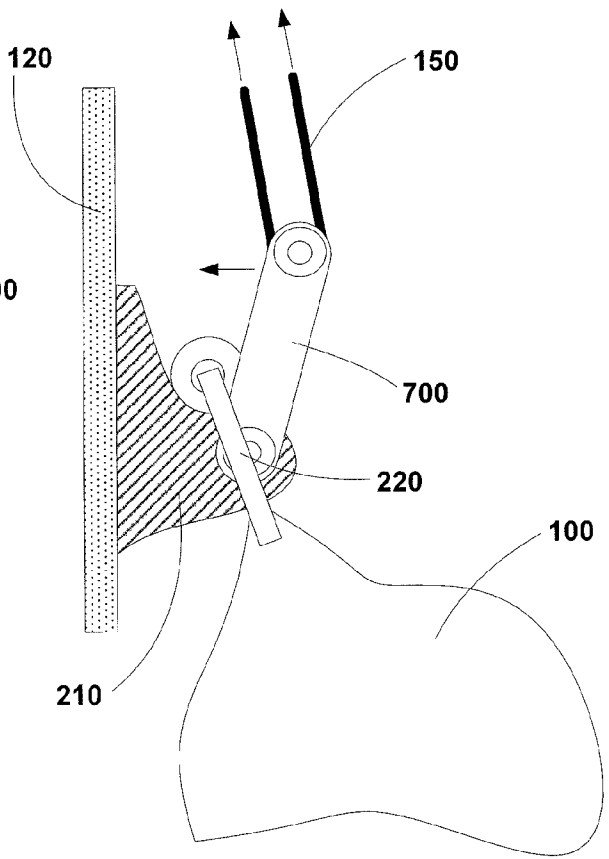
FIG. 7B illustrates the headboard of FIG. 7A mated with the headcar with a toggle.
Figure 7A:
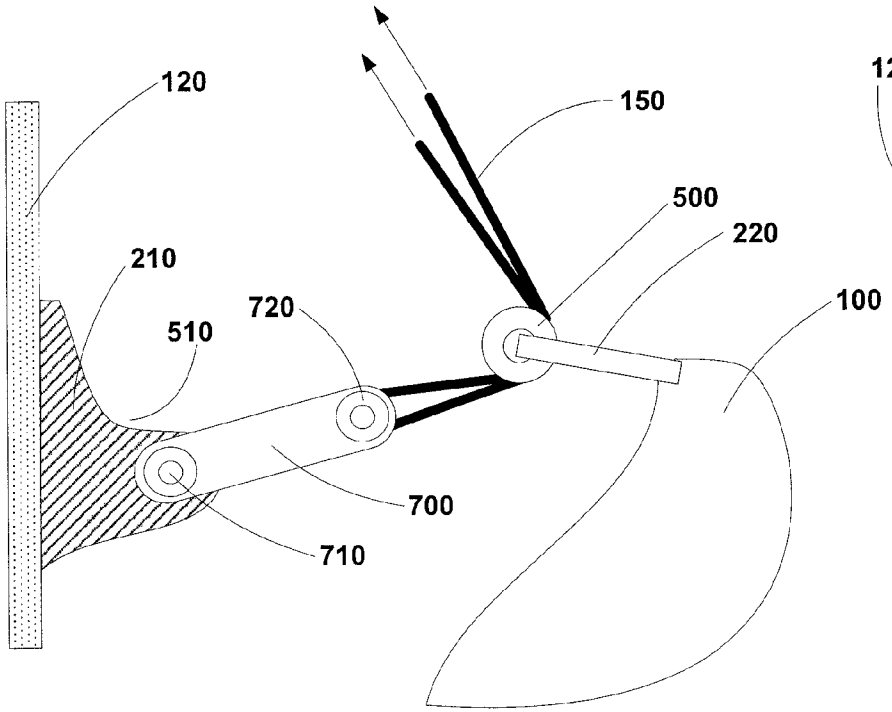
FIG. 7A illustrates a double halyard attached to a headcar with a toggle and urging a headboard toward the headcar.

A pivotable toggle 700 may be utilized to aid in the securing of the headboard 220 to the headcar 210 as illustrated in FIGS. 7A-B. The toggle 700 extends outward from the headcar 210 and pivots about an axle 710. The toggle 700 may include at least one sheave 720. In the configuration shown in FIGS. 7A-B, a typical double halyard arrangement, the halyard 150 is looped around both the toggle sheave 720 and the headboard sheave 500. FIG. 7A illustrates that tension from a pulling force applied to the halyard 150 extends the toggle 700 and urges the headboard 220 toward the headcar 210.

As the sail 100 continues to be raised, the toggle 700 may be received in a hollow interior or cavity 1000 (See FIG. 10) in the headboard 220 as shown in FIG. 7B. The tension in the halyard 150 pivots the toggle 700 upward to a raised position during the unfurling process. When the sail 100 is fully raised, the headboard sheave 500 is secured in the receiving area 510 of the headcar 210. The toggle 700 will remain in the raised position so long as tension is maintained in the halyard 150. In various embodiments, when the toggle 700 is in the raised position, the toggle 700 may be angled slightly aft so that the halyard 150 is held away from the mast 120 and produces a force (so long as there is tension in the halyard) that maintains a secure connection between the headboard 220 and headcar 210.

It should be noted that a one-part halyard is illustrated in FIGS. 6A-B and 7A-B, while other figures show a two-part halyard configuration. Those skilled in the art will recognize that either a one-part or two-part configuration may be utilized for any of the various configurations of the headcar 210 and the headboard 220.

Figure 8B:
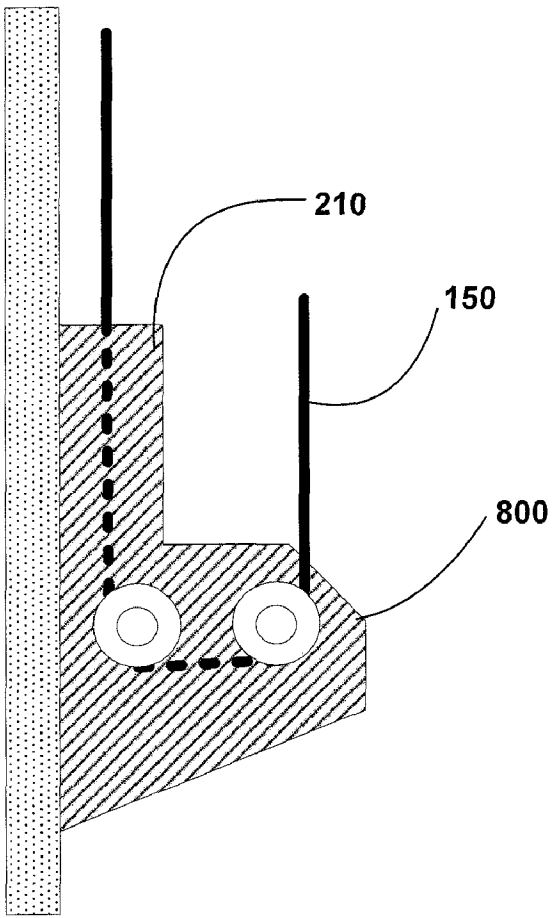
FIG. 8B illustrates a double halyard with a pair of sheaves in the headcar.
Figure 8A:
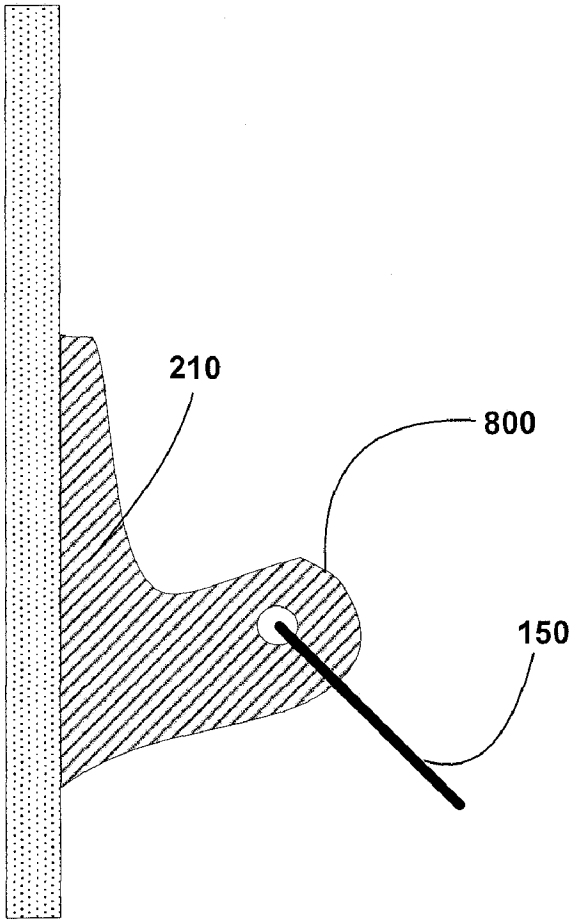
FIG. 8A shows a single halyard attached to a headcar.

As indicated above, the headcar 210 may have many conformations. FIG. 8A shows a headcar 210 used with a single halyard and FIG. 8B shows a headcar 210 in a double halyard installation. It should be noted that various embodiments of the headcar 210 may include a nosepiece 800. The nosepiece 800 guides the headcar 210 into a hollow interior or receiving cavity 1000 of the headboard 220.

Figure 9C:
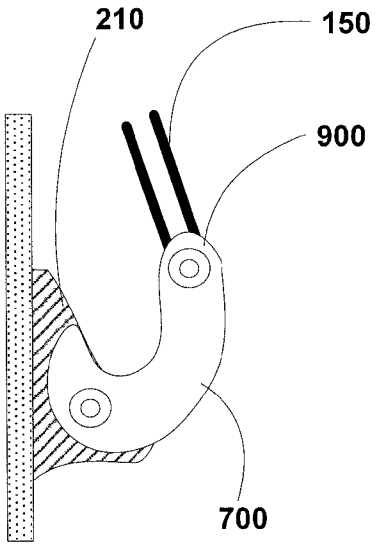
FIG. 9C shows another configuration of a headcar with a toggle and a double halyard.
Figure 9B:
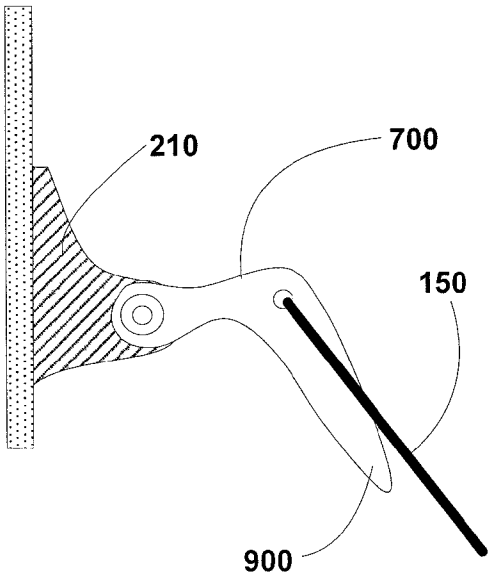
FIG. 9B shows another configuration of a headcar with a toggle and a single halyard.
Figure 9A:
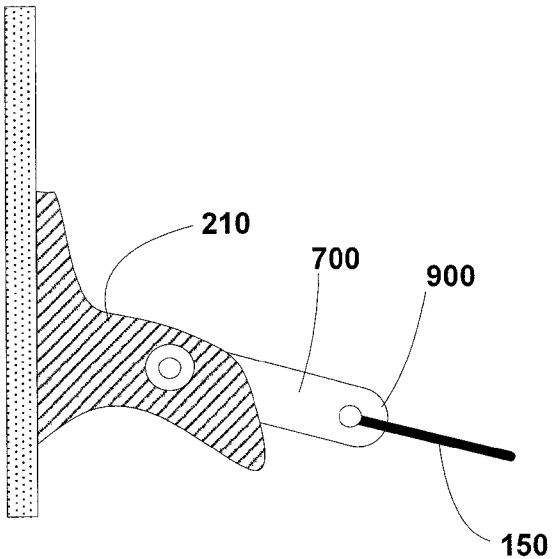
FIG. 9A depicts a single halyard affixed to a headcar with a toggle.

FIGS. 9A-C show various configurations for the headcar 210 when a toggle 700 is utilized. In various embodiments, the toggle 700 may include a nosepiece 900 that guides the headcar 210 into a hollow interior or receiving cavity 1000 (See FIG. 10) of the headboard 220. In some embodiments, the nosepiece 900 may be a band covering an opening for a sheave.

FIGS. 10A-C show headboards 220 that may be attached to the sail 100 at multiple attachment points. Also visible in FIG. 10C is the hollow interior of the headboard 220 that forms the receiving cavity 1000.

Figure 11:
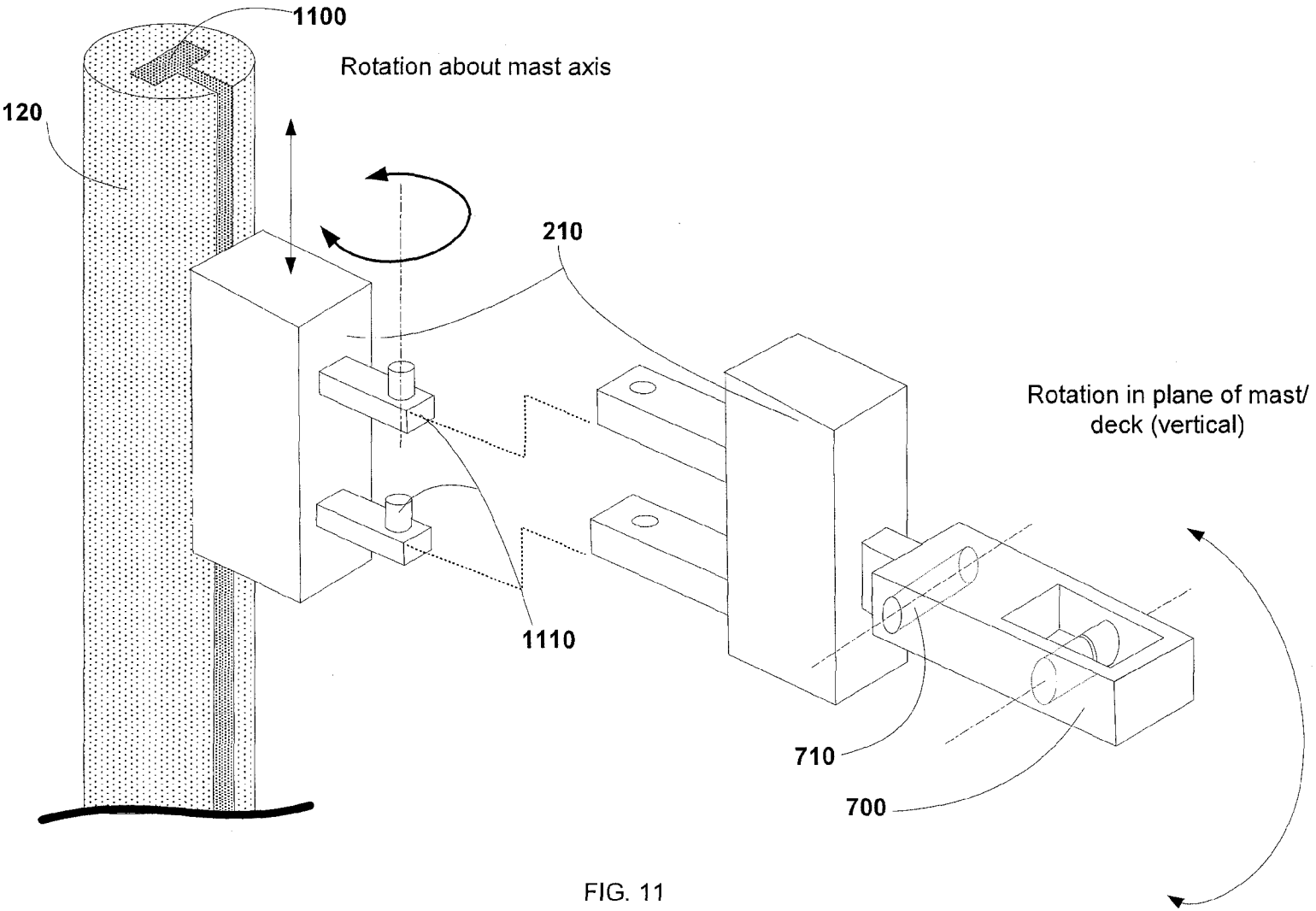
FIG. 11 shows the two axes of rotation of a headboard utilized in the sail handling mechanism.

FIG. 11 illustrates several movements that the headcar 210 may make. As described above, during sail raises and drops the headcar 210 travels up and down in the slide track 1100 on the mast 120.

The headcar 210 may also include a pivot mechanism 1110 that allows the headcar 210 to rotate about an axis parallel to the longitudinal axis of the mast 120. The pivot mechanism 1110 allows the headcar 210 to track the movement of the sail 100.

As discussed above with reference to multiple embodiments, the headcar 210 may also include an axle 710 which allows the toggle 700 to rotate about an axis of rotation that is perpendicular to the longitudinal axis of the mast 120.

Figure 12:
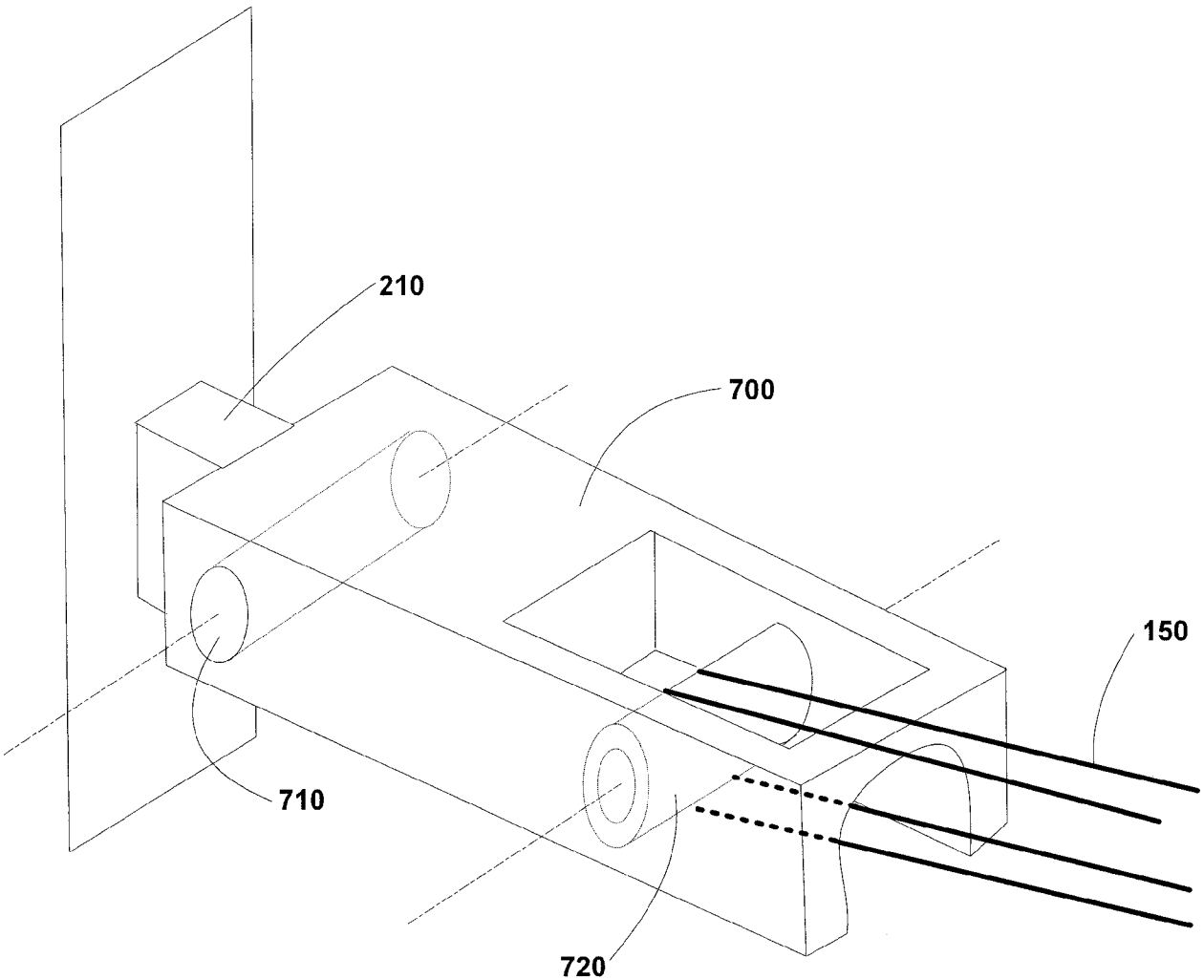
FIG. 12 shows a "block and tackle" halyard arrangement in combination with a headcar with a toggle.

FIG. 12 illustrates an embodiment of the headcar 210 with a block and tackle arrangement in which multiple turns of the halyard 150 are taken around the at least one sheave 720 in the toggle 700. The multiple turns of the halyard 150 provide the user additional mechanical advantage, which may be particularly useful with larger sails 100.

The embodiments described herein are illustrative of the present invention. As these embodiments of the present invention are described with reference to illustrations, various modifications or adaptations of the methods and or specific structures described may become apparent to those skilled in the art in light of the descriptions and illustrations herein. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A mechanism to raise and lower a sail on a sail boat comprising:

a headcar movably secured to a mast;

a headboard affixed to a sail; and a halyard coupled with the headcar and the headboard, wherein the headboard is separated from the headcar when the sail is lowered, and wherein the headboard engages the headcar when a pulling force is applied to the halyard, the headcar moving to an upper end of the mast to raise the sail in response to the pulling force on the halyard.

2. The mechanism of claim 1, wherein the headcar includes a securing element that secures the headboard to the headcar when the headboard is engaged with the headcar.

3. The mechanism of claim 1, wherein the headboard includes a receiving cavity that receives at least a portion of the headcar when the headboard is engaged with the headcar.

4. The mechanism of claim 3, wherein the headcar includes a nosepiece that guides the headcar into the headboard.

5. The mechanism of claim 1, wherein the headcar includes a pivoting toggle.

6. The mechanism of claim 5, wherein the halyard passes through a sheave of the toggle.

7. The mechanism of claim 5, wherein the headboard includes a receiving cavity that receives at least a portion of the toggle when the headboard engages the headcar.

8. The mechanism of claim 5, wherein pressure from the halyard pivots the toggle upward to a raised position, the toggle securing the headboard in close proximity to the headcar.

9. The mechanism of claim 8, wherein the toggle in the raised position contacts a pin in the headboard.

10. The mechanism of claim 1, wherein the halyard passes through a sheave in the headboard.

11. The mechanism of claim 1, wherein the headcar pivots about an axis parallel to a longitudinal axis of the mast.

12. A system to raise and lower a sail on a sailboat on a sail boat comprising:

at least one headcar movably installed in a track on a mast;

a headboard affixed to a head of a luff of a sail; and a halyard coupled with the headboard and the headcar, so that a pulling force applied to the halyard engages the headboard with the headcar when the sail is raised, the headboard disengaging from the headcar when the sail is lowered.

13. The system of claim 12, wherein the headcar pivots about an axis parallel to a longitudinal axis of the mast.

14. The system of claim 12, wherein the headcar includes a securing element that secures the headboard to the headcar.

15. The system of claim 12, wherein the headboard includes a receiving cavity that receives at least a portion of the headcar.

16. The system of claim 15, wherein the headcar includes a nosepiece that guides the headcar into the headboard when the headcar engages the headboard.

17. The system of claim 12, wherein the headcar includes a toggle which pivots in a plane that passes through a longitudinal axis of the mast.

18. The system of claim 17, wherein the halyard passes through a sheave of the toggle.

19. The system of claim 17, wherein the headboard includes a receiving cavity that receives at least a portion of the toggle.

20. The system of claim 17, wherein pressure from the halyard pivots the toggle upward to a raised position, the toggle securing the headboard in close proximity to the headcar.

21. The system of claim 20, wherein the toggle in the raised position contacts a pin in the headboard.

22. The system of claim 12, wherein the halyard passes through a sheave in the headboard.

23. A headcar to raise and lower a sail on a sail boat comprising:

an attaching mechanism to movably secure the headcar to a mast, the attaching mechanism also allowing the headcar to pivot about an axis parallel to a longitudinal axis of the mast; and an engaging element that releasably engages a headboard, the engaging element disengaging the headcar from the headboard when the headcar moves down the mast, and the engaging element engaging the headcar with the headboard when the headcar moves up the mast.

24. The headcar of claim 23, wherein a securing element secures the headboard to the headcar when the headboard is engaged with the headcar.

25. The headcar of claim 23, wherein the headcar includes a nosepiece that guides the headcar into the headboard.

26. The headcar of claim 23, wherein the headcar includes a pivoting toggle.

27. A headboard to raise and lower a sail on a sailboat comprising:

one or more affixing elements to affix the headboard to the sail; and an engaging element that releasably engages a headcar, the engaging element disengaging the headboard from the headcar when the headcar moves down a mast, and the engaging element engaging the headboard with the headcar when the headcar moves up the mast.

28. The headboard of claim 27, wherein the headboard includes an attaching element that secures the headboard to the headcar when the headboard is engaged with the headcar.

29. The headboard of claim 27, further including a receiving cavity that receives at least a portion of the headcar when the headboard is engaged with the headcar.

* * * * *